US008177694B1

(12) United States Patent
Walker

(10) Patent No.: US 8,177,694 B1
(45) Date of Patent: May 15, 2012

(54) CHIN-UP EXERCISE APPARATUS AND METHOD

(76) Inventor: Gavin M. Walker, Sandy, UT (US)

( * ) Notice: Subject to any disclaimer, the term of this patent is extended or adjusted under 35 U.S.C. 154(b) by 0 days.

(21) Appl. No.: 12/952,130

(22) Filed: Nov. 22, 2010

(51) Int. Cl.
*A63B 21/00* (2006.01)

(52) U.S. Cl. ..... 482/126; 482/39; 482/40

(58) Field of Classification Search ..... 482/904, 482/907, 126, 121
See application file for complete search history.

(56) References Cited

U.S. PATENT DOCUMENTS 5,295,935 A * 3/1994 Wang ..... 482/130
5,417,628 A 5/1995 Vanderbleek
5,588,942 A * 12/1996 Dillard ..... 482/139
6,503,175 B1 1/2003 Harrell
7,066,866 B1 * 6/2006 Mobley ..... 482/40
7,540,831 B2 6/2009 Hauser et al.
D627,011 S * 11/2010 Potok ..... D21/662
2004/0053752 A1 * 3/2004 Yang ..... 482/70

* cited by examiner

*Primary Examiner* — Jerome w Donnelly
(74) *Attorney, Agent, or Firm* — Warren M. Pate, LLC

(57) ABSTRACT

An exercise apparatus is disclosed. The exercise apparatus may include a frame and a rail suspended from the frame. The rail may have a length extending horizontally. The exercise apparatus may further include two carriages, each configured to roll along the rail independent of one another. A handle may be connected to each carriage. A user may grasp the handles, one with each hand, and execute an exercise such as a chin-up, pull-up, bicep curl, lat pulldown, or the like.

20 Claims, 6 Drawing Sheets

CHIN-UP EXERCISE APPARATUS AND METHOD

BACKGROUND

1. The Field of the Invention

This invention relates to exercise equipment and, more particularly, to novel systems and methods for use in chin-ups, pull-ups, lat pulldown, and the like.

2. The Background Art

Mechanized exercise equipment can often provide greater variability and safety than free weights. However, mechanized exercise equipment can impose motions that may not be natural or comfortable to all users. As appreciated, users can vary widely in dimensions, proportions, and the like. Additionally, mechanized exercise equipment often balances or stabilizes the load lifted by the user. While this may improve safety, it may also prevent the user from developing the balance and stability truly associated with the load. Accordingly, what is needed is an exercise apparatus that supports a more natural motion and requires the user to exhibit greater control.

BRIEF SUMMARY OF THE INVENTION

The invention has been developed in response to the present state of the art and, in particular, in response to the problems and needs in the art that have not yet been fully solved by currently available apparatus and methods. The features and advantages of the invention will become more fully apparent from the following description and appended claims, or may be learned by practice of the invention as set forth hereinafter.

In selected embodiments, an exercise apparatus in accordance with the present invention may include a rail, first carriage, second carriage, first handle, and second handle. The first and second carriages may freely travel (e.g., roll with little friction) along the rail. The first handle and second handle may be pivotably connected to the first carriage and second carriage, respectively.

When an exercise apparatus in accordance with the present invention is being used for chin-ups, pull-ups, lat pulldown, or the like, a user may grasp the apparatus such that one hand grips the first handle and the other hand grips the second handle. During the chip-up, pull-up, lat pulldown, or the like, one or both of the carriages may move along the rail. Accordingly, the distance between the two handles may change during the exercise. This movement may support a more natural motion by the user. The movement may also require the user to exhibit greater control over the exercise.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
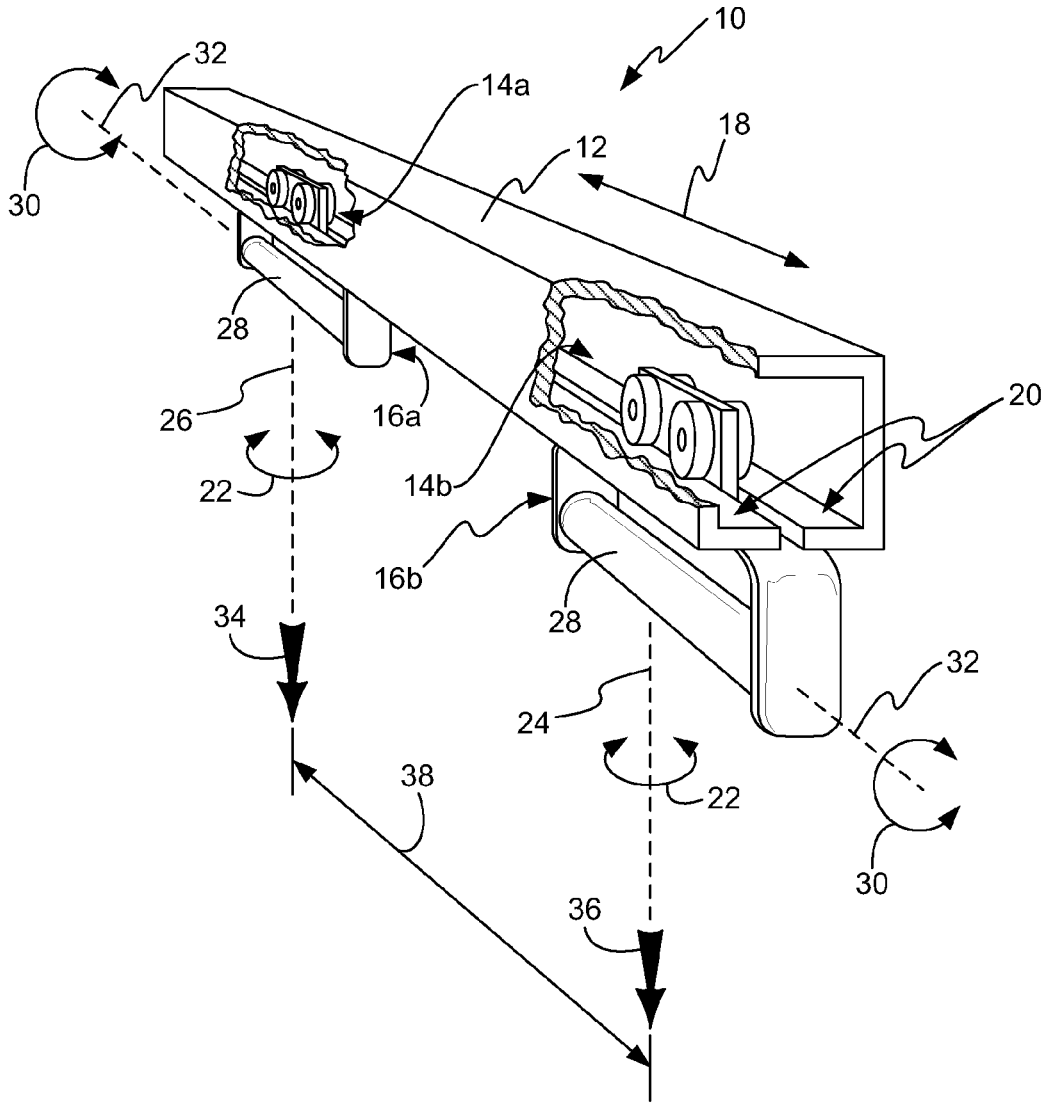
FIG. 1 is a perspective, partial cut-away view of one embodiment of a rail, carriage, and handle system in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, an exercise apparatus 10 in accordance with the present invention may include a rail 12, first carriage 14*a*, second carriage 14*b*, first handle 16*a*, and second handle 16*b*. The rail 12 may extend in a longitudinal direction 18 and include one or more bearing surfaces 20. The first and second carriages 14*a*, 14*b* may travel (e.g., roll) along the one or more bearing surfaces 20. The first handle 16*a* may be connected to travel with the first carriage 14*a*. The second handle 16*b* may be connected to travel with the second carriage 14*b*.

In selected embodiments, the first handle 16*a* and second handle 16*b* may be pivotably connected to the first carriage 14*a* and second carriage 14*b*, respectively. For example, a first handle 16*a* may be connected to a first carriage 14*a* in a manner supporting rotation 22 or pivoting 22 about an axis 24 extending substantially orthogonally with respect to the longitudinal direction 18. A second handle 16*b* may be connected to a second carriage 14*b* in a manner supporting rotation 22 or pivoting 22 about a different axis 26 extending substantially orthogonally with respect to the longitudinal direction 18.

In certain embodiments, a grip 28 of a handle 16*a*, 16*b* may be fixed with respect to the rest of the handle 16*a*, 16*b*. Alternatively, a grip 28 may be free to move with respect to the rest of the handle 16*a*, 16*b*. For example, when pivoted 22 into alignment (i.e., a parallel arrangement) with a rail 12, a grip 28 may be connected to the rest of the handle 16*a*, 16*b* in a manner supporting rotation 30 or pivoting 30 about an axis 32 extending substantially parallel to the longitudinal direction 18.

During use of the exercise apparatus 10, the first and second carriages 14*a*, 14*b* may travel with respect to the rail 12. For example, when an apparatus 10 in accordance with the present invention is being used for chin-ups, pull-ups, or the like, a user may grasp the apparatus 10 such that one hand grips the first handle 16*a* and the other hand grips the second handle 16*b*. The user may then suspend his or her weight from the first and second handles 16*a*, 16*b*. A first portion 34 of the user's weight may be applied the first handle 16*a*, while a remaining portion 36 of the user's weight may be applied the second handle 16*b*. The user may then execute a chip-up, pull-up, or the like.

During the chip-up, pull-up, or the like (e.g., as the user is lifting himself or herself toward the apparatus 10, lowering himself or herself away from the apparatus 10, etc.), one or both of the carriages 14*a*, 14*b* may move along the rail 12. Accordingly, the distance 38 between the two handles 16*a*, 16*b* may change during the exercise. This movement may support a more natural motion, tracking the biomechanical tendencies or preferences of the user. The movement may also require the user to exhibit greater control, which may involve more of the user's muscles in the exercise and provide a more balanced or distributed workout.

Figure 2:
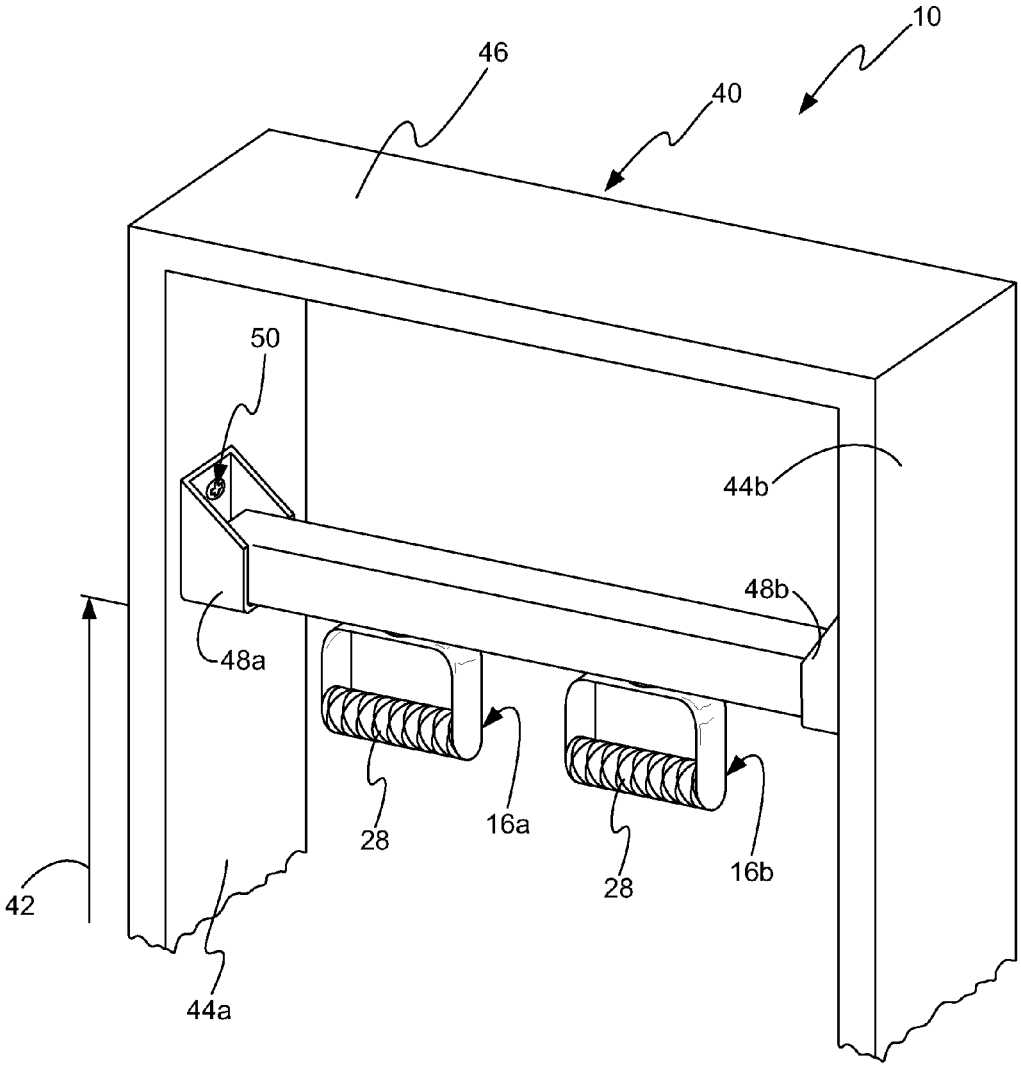
FIG. 2 is a perspective view of the rail, carriage, and handle system of FIG. 1 supported by a frame in accordance with the present invention.

Referring to FIG. 2, a rail 12 and associated carriages 14*a*, 14*b* and handles 16*a*, 16*b* may be supported or suspended in any suitable manner. In selected embodiments, an exercise apparatus 10 in accordance with the present invention may include a frame 40 holding the rail 12 stationary and horizontally level some distance 42 above a floor surface. The magnitude of this distance 42 may depend on the exercise to be executed. For example, the spacing 42 from the floor may be less with a reclined pull-up than with a traditional, standing or vertical pull-up.

In selected embodiments, a frame 40 may include a first side support 44*a*, second side support 44*a*, and lateral support 46 extending to connected the first side support 44*a* to the second side support 44*b*. In certain alternative embodiments, a rail 12 may perform the function of a lateral support 46, and the lateral support 46 may be omitted. A frame 40 may comprise a stand-alone or dedicated structure. For example, a frame 40 may be self-standing and transportable. Such a frame 40 may comprise a superstructure and a base, holding the superstructure erect. Alternatively, a frame 40 may be a structure having other uses. For example, in selected embodiments, a frame 40 may comprise a door frame.

A rail 12 may be connected to a frame 40 in any suitable manner. In certain embodiments, a rail 12 may be welded, bolted, or otherwise fastened to the frame 40. Alternatively, brackets 48*a*, 48*b* may form an interface between a rail 12 and a frame 40. For example, a first bracket 48*a* may support or engage one end of the rail 12, while a second bracket 48*b* may support or engage the other end of the rail 12. The brackets 48*a*, 48*b* may be connected to the frame 40 in any suitable manner. In the illustrated embodiment, the brackets 48*a*, 48*b* are secured to the frame by one or more fasteners 50.

In certain embodiments, the brackets 48*a*, 48*b* may be left in place while a rail 12 is selectively removed therefrom. With the rail removed 12, a frame 40 may be converted to some other use. For example, in selected embodiments, a frame 40 may return to use as a door frame. In such embodiments, the bracket 48*a*, 48*b* may be positioned to as to not interfere with the operation of a door within the door frame.

Alternatively, a frame 40 may be converted for use in connection with some other exercise. For example, a frame 40 may be equipped with multiple bracket pairs 48*a*, 48*b*. When suspended from different bracket pairs 48*a*, 48*b*, a rail 12 may support different exercises. Accordingly, a user may selectively transition a rail 12 from one bracket pair 48*a*, 48*b* to another to perform a different exercise (e.g., to transition from a reclined pull-up to a vertical pull-up). Multiple bracket pairs 48*a*, 48*b* may also enable a single frame 40 to accommodate users of differing height.

Figure 3:
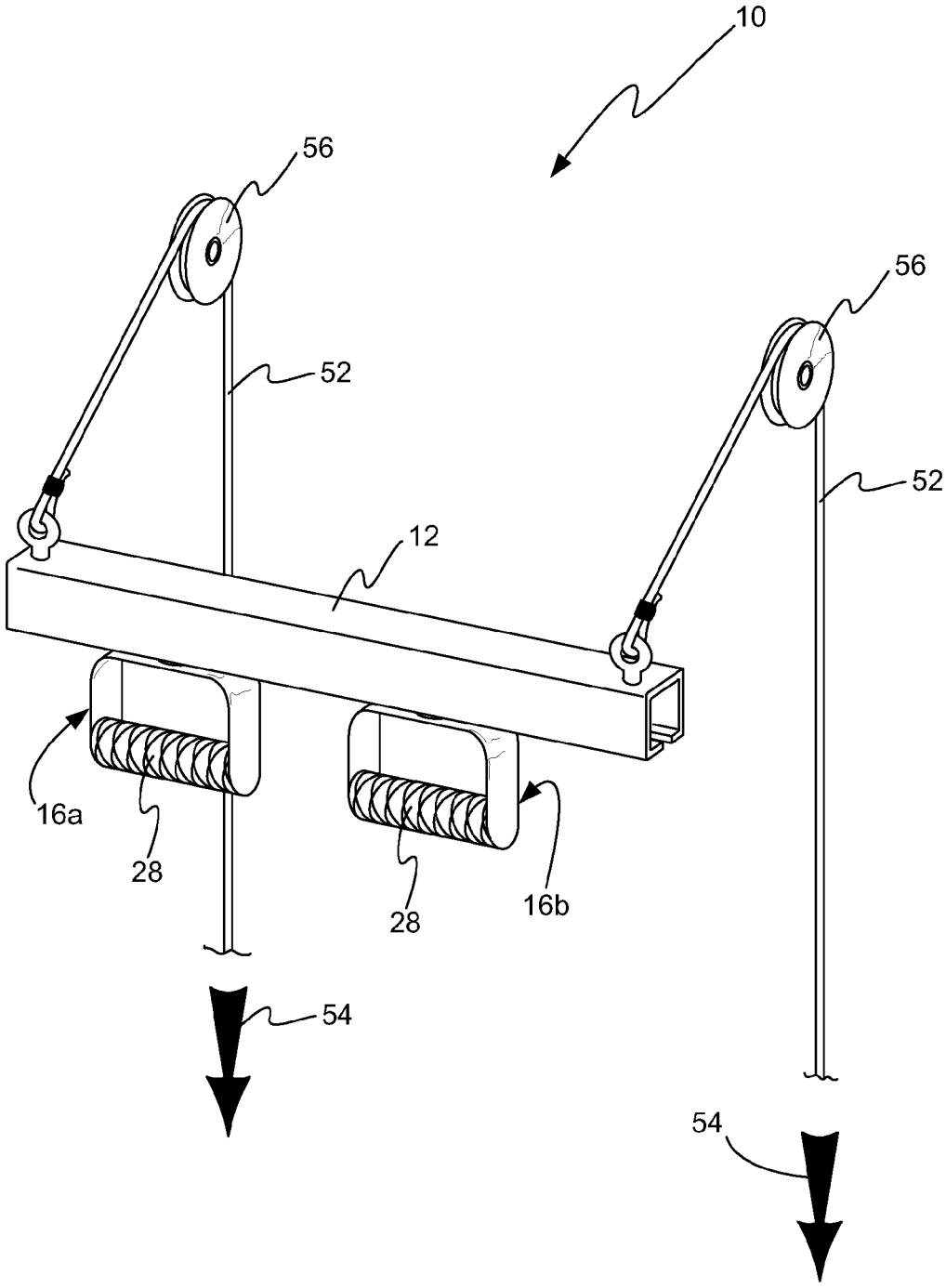
FIG. 3 is a perspective view of an alternative embodiment of a rail, carriage, and handle system suspended from flexible tethers in accordance with the present invention.

Referring to FIG. 3, in selected embodiments or arrangements, a rail 12 may be held substantially stationary during an exercise. In such embodiments or arrangements, a user may move with respect to the rail 12. In other embodiments or arrangements, a rail 12 may be dynamic (i.e., freed to move during an exercise). For example, in certain embodiments or arrangements, a rail 12 may be coupled to one or more resistance mechanisms by one or more flexible tethers 52 (e.g., cables 52). In selected embodiments, a single tether 52 may secure to a rail 12 proximate a midpoint thereof. In other embodiments, one tether 52 may engage each end of a rail 12.

A resistance mechanism may be or include one or more weights, springs, elastomeric materials, or the like. Movement of a rail 12 may be opposed by the forces 54 applied by the resistance mechanisms to the flexible tethers 52. In selected embodiments, the forces 54 may be constant throughout the exercise-specific range of motion of the rail 12. Alternatively, the forces 54 may vary across the range of motion of the rail 12. For example, in certain embodiments, the forces 54 may increase with increasing distance of the rail 12 from its home, base, or neutral position.

In selected embodiments, a frame 40 may support a rail 12 exclusively in one or more stationary positions or configurations. In other embodiments, a frame 40 may support a rail 12 exclusively in one or more dynamic configurations. In still other embodiments, a frame 40 may selectively support a rail 12 in one or more positions or configurations that can be either stationary or dynamic.

For example, in certain embodiments, a frame 40 may secure, steady, or otherwise support one or more resistance mechanisms. The frame 40 may also support and position one or more pulleys 56. Such pulleys 56 may provide redirection of the forces 54 corresponding to the one or more resistance mechanisms. Accordingly, different pulleys 56, different flexible tethers 52, or combinations thereof may support a variety of exercises.

That is, certain pulleys 56, flexible tethers 52, or the like may support exercises wherein the rail 12 is pulled down by a user (e.g., lat pulldown). Other pulleys 56, flexible tethers 52, or like (or the same pulleys 56, tethers 52, or the like in new positions) may support exercises wherein the rail 12 is pulled up (e.g., bicep curl). Accordingly, a frame 40 may support a wide variety of exercises utilizing a rail 12 that can be moved by a user.

In both stationary and dynamic configurations, a rail 12 and associated carriages 14*a*, 14*b* and handles 16*a*, 16*b* may require that a user exhibit greater control and stability than that required by conventional rigid bars. For example, when using a rail 12 in accordance with the present invention in a lat pulldown exercise, a user may not be permitted to pull harder with a stronger or preferred arm.

If a user were to pull unevenly on an apparatus 10 in accordance with the present invention, the rail 12 may tilt toward that stronger or preferred arm, causing both carriages 14*a*, 14*b* to travel (e.g., roll) with respect to the rail 12. This travel may accentuate or highlight the underlying or initial imbalance. Accordingly, to properly execute the exercise, the user may be required to steadily and evenly load the individual carriages 14*a*, 14*b* and corresponding rail 12.

Figure 4:
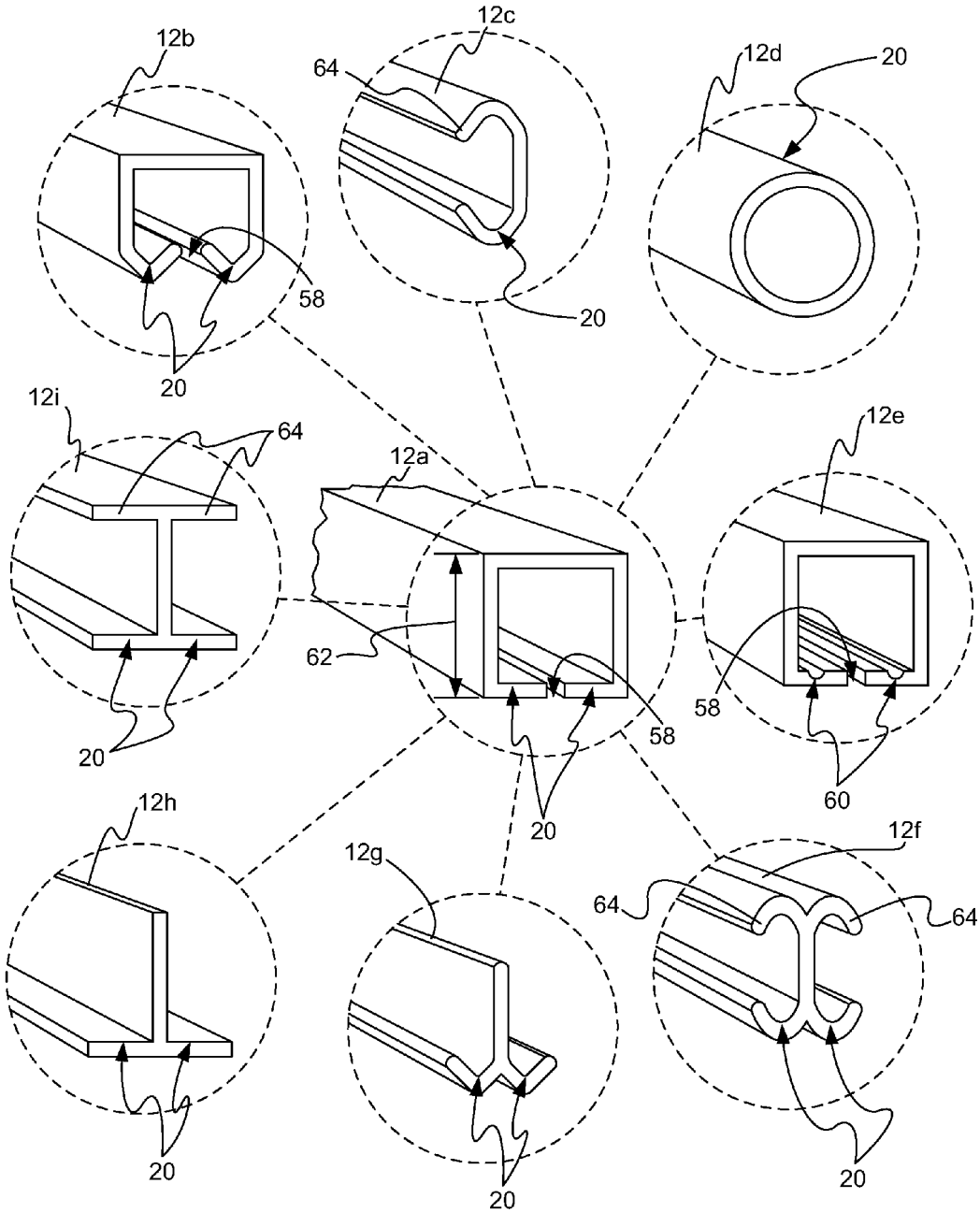
FIG. 4 is a partial perspective view of one embodiment of a rail, coupled with various alternative rails that may be substituted therefor in accordance with the present invention.

Referring to FIG. 4, a rail 12 in accordance with the present invention may have any suitable configuration. In selected embodiments, a rail 12*a*, 12*b*, 12*c*, 12*e*, 12*f*, 12*g*, 12*h*, 12*i* may define an interior cavity (e.g., a concavity) within which a carriage 14 (or a portion thereof) may travel. Accordingly, in such embodiments, the one or more bearing surfaces 20 of the rails 12*a*, 12*b*, 12*c*, 12*e*, 12*f*, 12*g*, 12*h*, 12*i* may be considered to be interior surfaces. In other embodiments, the bearing surfaces 20 of a rail 12*d* may be exterior surfaces. For example, in selected embodiments, a rail 12*d* may comprise a tube and a carriage 14 may include one or more wheels configured to roll along the outside of the tube.

In certain embodiments, a rail 12*a*, 12*b*, 12*e* may substantially enclose a volume therewithin. This interior volume may provide a space in which the carriages 14 may travel. In such embodiments, a slot 58 may be formed in the rail 12*a*, 12*b*, 12*e*. A carriage 14 traveling within such a rail 12*a*, 12*b*, 12*e* may extend through the slot 58 to engage a corresponding handle 16. In this manner, a rail 12*a*, 12*b*, 12*e* may substantially block the corresponding carriages 14 from view (providing an aesthetically pleasing result) and protect them (as well as the bearing surfaces 20 and the like) from dust and debris.

Bearing surfaces 20 may have any suitable configuration. Selected rails 12*a*, 12*h*, 12*i* may have one or more bearing surfaces 20 that are flat. Other rails 12*b*, 12*c*, 12*f*, 12*g* may have one or more bearing surfaces 20 that are concave. For example, the bearing surfaces 20 may have a "U" or "V" shaped cross-section corresponding to the profile of a carriage wheel rolling therealong or therewithin. Other rails 12*d* may have one or more convex bearing surfaces 20. Still other rails 12*e* may have one or more bearing surfaces 20 configured for a particular purpose. For example, certain rails 12*e* may include one or more bearing surfaces 20 comprising a race 60 or groove 60 for accommodating ball bearings.

Rails 12 in accordance with the present invention may be formed of any suitable material. Suitable materials may include metals, metal alloys, composites, and combinations thereof. In selected embodiments, a rail 12 may comprise an aluminum extrusion. The shape or cross-section of a rail 12 may be selected to provide desired structural characteristics. For example, the height 62 (or some other dimension affecting section modulus) of a rail 12 may be selected to withstand the anticipated bending loads. Other cross-sectional features (e.g., overhangs 64) may be included as necessary or desired to retain a carriage 14 as it travels along a rail 12.

Figure 5:
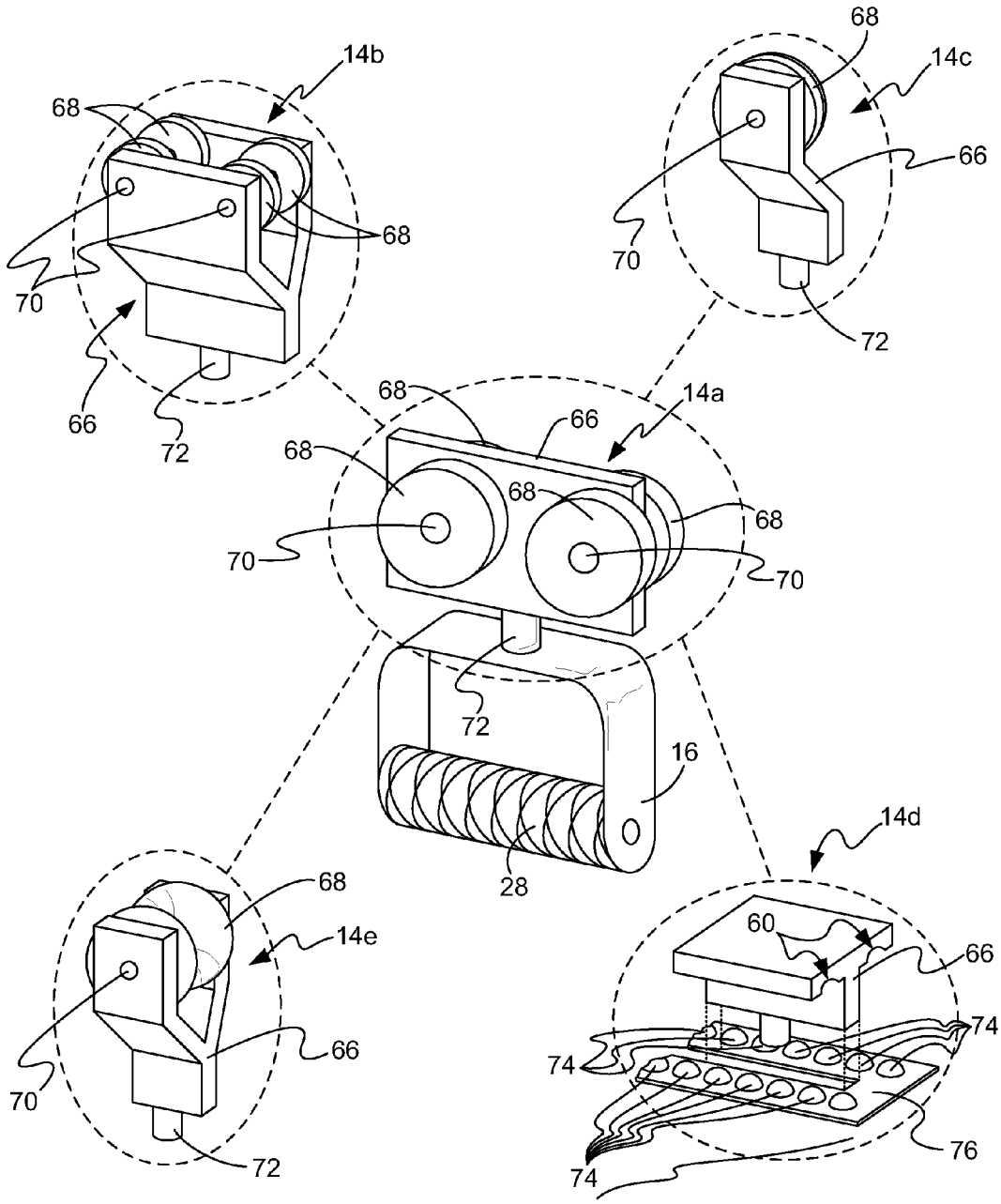
FIG. 5 is a perspective view of one embodiment of a carriage, coupled with various alternative carriages that may be substituted therefor in accordance with the present invention.

Referring to FIG. 5, a carriage 14 in accordance with the present invention may have any suitable configuration. In selected embodiments, a carriage 14 may include a body 66, one or more wheels 68, one or more pivots 70 (e.g., axles 70), and an engagement mechanism 72. The pivots 70 may connect the wheels 68 to the body 66 of the carriage 14. The pivots 70 may include bearings, bushings, lubricant, combinations thereof, or the like to enable the wheels 68 to turn freely with respect to the body 66.

The wheels 68 of a carriage 14 may have an exterior or rolling surface shaped to match the bearing surfaces 20 of a corresponding rail 12. In general, flat wheels 68 (i.e., wheels 68 with flat rolling surfaces) may be applied to flat bearing surfaces 20, convex wheels 68 may be applied to concave bearing surfaces 20, and concave wheels 68 may be applied to convex bearing surfaces 20. For example, one or more wheels 68 of certain carriages 14*e* may have a concave shape selected to match the convex shape of the bearing surface 20 of corresponding rail 12*d*.

In selected embodiments, the material forming or defining the rolling surface of a wheel 68 may be selected to provide a desired rolling resistance along a corresponding bearing surface 20. In general, the harder the material, the lower the rolling resistance. In certain embodiments, the material may comprise metal or a metal alloy to provide low rolling resistance.

Certain carriages 14*c*, 14*e* may include a single wheel 68. In such embodiments, a body 66 of the carriage 14 may pivot somewhat with respect to a rail 12 about the axle 70 of the wheel 68. This pivoting may induce travel of the carriage 14 along the rail 12. In other embodiments, a carriage 14 may include two wheels 68. The two wheels 68 may be positioned in-line to roll along a common bearing surface 20. Alternatively, the two wheels 68 may be positioned out of line (e.g., side-by-side) and roll along different bearing surfaces 20.

Other carriages 14*a*, 14*b* may include four wheels 68. In such embodiments, two of the wheels 68 may be position in-line with respect to one another and roll along a first bearing surface 20. The other two wheels 68 may be position in-line with respect to one another and roll along a second bearing surface 20. Two or more wheels 68 positioned in-line may tend to resist pivoting of the body 66 of the carriage 14 with respect to the corresponding rail 12.

The one or more wheels 68 of certain carriages 14*a*, 14*c* may be positioned substantially exterior to the body 66 of the carriage 14*a*, 14*c*. The one or more wheels 68 of other carriages 14*b*, 14*e* may be positioned substantially interior to the body 66 of the carriage 14*b*, 14*e*. Accordingly, bodies 66 of certain carriages 14*a* may corresponding to certain types of rails 12*a*, 12*b*, while bodies 66 other carriages 14*b* may correspond to other types of rails 12*f*, 12*g*, 12*h*, 12*i*. Similarly, carriages 14*c*, 14*e* having one wheel 68 (or multiple wheels 68 positioned in-line) may correspond to rails 12*c*, 12*d* having a single bearing surface 20.

In certain embodiments, the wheels 68 of a carriage 14 may be omitted. In such embodiments, the wheels 68 may be replaced by one or more other mechanisms provide easy (e.g., low friction) travel of the carriage 14 along a corresponding rail 12. For example, selected carriages 14*d* may include ball bearings 74 spaced and supported (e.g, held in place) by a bearing mount 76. The bearing mount 76 may be free to move with respect to, and have a length greater than, the body 66 of the carriage 14*d*. Accordingly, with races 60 in both the body 66 of the carriage 14*d* and in the bearing surfaces 20 of the corresponding rail 12*e*, the carriage 14*d* may easily travel along the rail 12*e*.

In selected embodiments, a carriage 14 may include two rows of ball bearings. The two rows may be spaced horizontally from one another in the manner illustrated. Alternatively, the two rows may be spaced vertically (e.g., similar to certain heavy duty drawer slides).

An engagement mechanism 72 may extend from the body 66 of a carriage 14 to engage or secure a handle 16. The engagement mechanism 72 may engage the handle 16 in any suitable manner. In selected embodiments, the engagement mechanism 72 may engage the handle 16 in a manner supporting pivoting 22 of the handle 16 with respect to the corresponding carriage 14. An engagement mechanism 72 may include bearings, bushings, lubricant, combinations thereof, or the like to enable the handle 16 to pivot 22 more freely with respect to the carriage 14.

Figure 6:
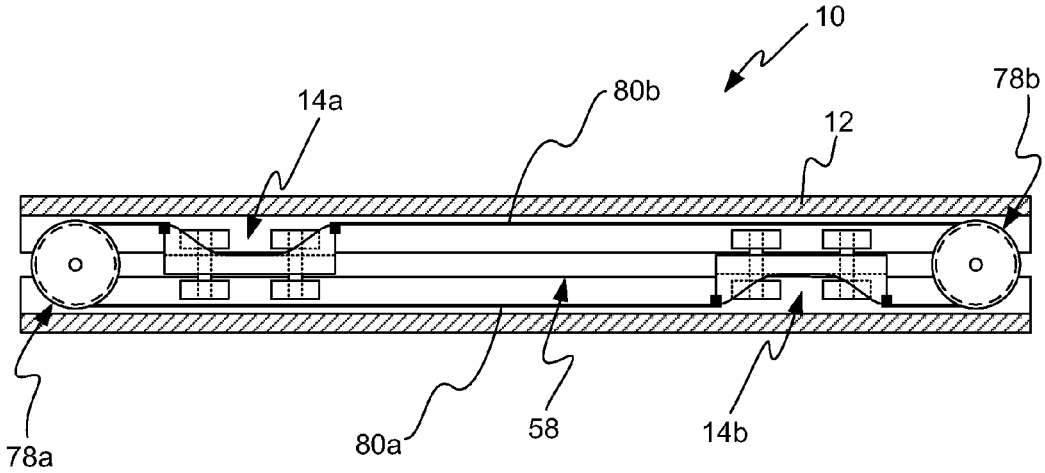
FIG. 6 is a top, cross-sectional view of an alternative embodiment of a rail and carriage system in accordance with the present invention with the two carriages linked together.

Referring to FIG. 6, in selected embodiments, an exercise apparatus 10 in accordance with the present invention may include a first carriage 14*a* linked to a second carriage 14*b*. The linkage may ensure or enforce a particular relative motion between the first and second carriages 14*a*, 14*b*. In certain embodiments, the linkage may substantially prevent relative motion between the first and second carriages 14*a*, 14*b*, while permitting the first and second carriages 14*a*, 14*b* to travel with respect to the rail 12. Alternatively, the linkage may ensure equal and opposite motion between the first and second carriages 14*a*, 14*b*.

For example, in certain embodiments, an apparatus 10 may include a first pulley 78*a*, second pulley 78*b*, first flexible tether 80*a* (e.g., cable 80*a*), and second flexible tether 80*b* (e.g., cable 80*b*). The first flexible tether 80*a* may connect the first carriage 14*a* to the second carriage 14*b* and extend around the first pulley 78*a*. The second flexible tether 80*b* may connect the first carriage 14*a* to the second carriage 14*b* and extend around the second pulley 78*b*. Accordingly, any motion of one carriage 14*a*, 14*b* along a rail 12 may be communicated to, and oppositely matched by, the other carriage 14*a*, 14*b*. Such embodiments may support changes in the distance 38 between handles 16*a*, 16*b*, while maintaining a balanced loading of the corresponding rail 12.

Figure 7:
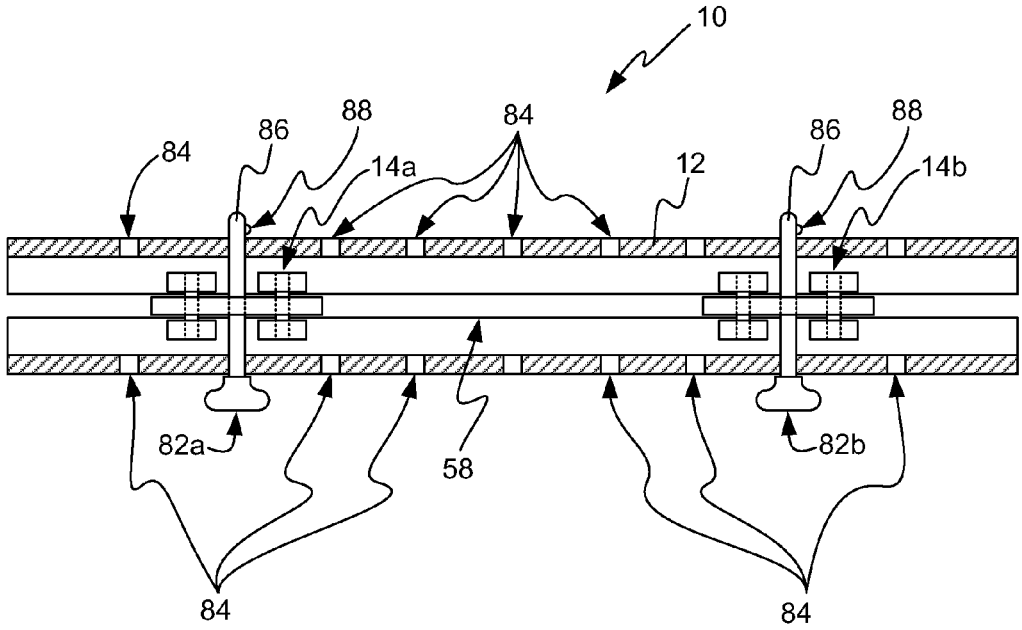
FIG. 7 is a top, cross-sectional view of one embodiment of a rail, carriage, and lock system in accordance with the present invention.

Referring to FIG. 7, in certain applications, it may be desirable to lock one or both carriages 14*a*, 14*b* with respect to the corresponding rail 12. Accordingly, in selected embodiments, an exercise apparatus 10 may include one or more locks 82. A lock 82 may selectively prevent or resist travel of a corresponding carriage 14 along a rail 12. In certain embodiments, an apparatus 10 may include a first lock 82*a* selectively securing a first carriage 14*a* and a second lock 82*b* selectively securing a second carriage 14*b*.

A lock 82 may have any suitable configuration. In selected embodiments, a rail 12 may include an array of apertures 84 extending therethrough. A corresponding aperture may be formed in a carriage 14 (e.g., within the body 66 of a carriage 14). Accordingly, whenever the aperture within a carriage 14 aligns with one of the apertures 84 in the rail, a lock 82 may be inserted to secure the carriage 14 in place. In such embodiments, the lock 82 may comprise a pin 86. The lock may further include a detent 88 resisting inadvertent removal of the pin 86.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An exercise method comprising:
selecting an exercise apparatus comprising
a frame,
a rail suspended from the frame, the rail having a length extending horizontally,
a first carriage configured to travel along the rail,
a second carriage configured to travel along the rail,
a first handle connected to the first carriage, and
a second handle connected to the second carriage;
grasping, by a user, the exercise apparatus such that one hand of the user grips the first handle and the other hand of the user grips the second handle;
suspending, during the grasping, the weight of the user from the first and second handles;
executing, during the suspending, one of a chin-up or pull up; and
translating, during the executing, the first carriage along the rail.

2. The method of claim 1, further comprising pivoting, during the executing, the first handle with respect to the first carriage.

3. The method of claim 2, further comprising translating, during the executing, the second carriage along the rail.

4. The method of claim 3, further comprising pivoting, during the executing, the second handle with respect to the second carriage.

5. The method of claim 1, wherein the rail comprises one or more bearing surfaces.

6. The method of claim 5, wherein the first carriage comprises one or more wheels configured to roll along the one or more bearing surfaces.

7. The method of claim 6, wherein the translating comprises rolling the one or more wheels along the one or more bearing surfaces.

8. The method of claim 1, wherein the frame comprises a door frame having a first side and a second side opposite the first side.

9. The method of claim 8, wherein the exercise apparatus further comprises:
a first mount suspending one end of the rail from the first side of the door frame; and
a second mount suspending the other end of the rail from the second side of the door frame.

10. An exercise method comprising:
selecting an exercise apparatus comprising
one or more resistance mechanisms,
a rail connected to the one or more resistance mechanisms,
a first carriage configured to travel along the rail,
a second carriage configured to travel along the rail,
a first handle connected to the first carriage, and
a second handle connected to the second carriage;
grasping, by a user, the exercise apparatus such that one hand of the user grips the first handle and the other hand of the user grips the second handle;
drawing, during the grasping, the rail toward the user from a first location to a second location spaced from the first location;
resisting, by the one or more resistance mechanisms, the drawing; and
translating, during the drawing, the first carriage along the rail.

11. The method of claim 10, wherein the first location of the rail is above the second location of the rail.

12. The method of claim 10, wherein the second location of the rail is above the first location of the rail.

13. The method of claim 10, further comprising pivoting, during the drawing, the first handle with respect to the first carriage.

14. The method of claim 13, further comprising translating, during the drawing, the second carriage along the rail.

15. The method of claim 14, further comprising pivoting, during the drawing, the second handle with respect to the second carriage.

16. The method of claim 10, wherein the rail comprises one or more bearing surfaces.

17. The method of claim 16, wherein the first carriage comprises one or more wheels configured to roll along the one or more bearing surfaces.

18. The method of claim 17, wherein the translating comprises rolling the one or more wheels along the one or more bearing surfaces.

19. The method of claim 10, wherein the drawing comprises executing at least part an exercise selected from the group consisting of a lat pulldown and a bicep curl.

20. An exercise method comprising:
selecting an exercise apparatus comprising
a frame,
a rail suspended from the frame, the rail having a length extending horizontally,
a first carriage configured to travel along the rail,
a second carriage configured to travel along the rail,
a first handle connected to the first carriage, and
a second handle connected to the second carriage;
grasping, by a user, the exercise apparatus such that one hand of the user grips the first handle and the other hand of the user grips the second handle;

suspending, during the grasping, at least a portion of the weight of the user from the first and second handles;

drawing, during the suspending, the user toward the rail; and translating, during the drawing, the first carriage along the rail.

* * * * *